United States Patent [19]

Leigh et al.

[11] Patent Number: 4,559,056

[45] Date of Patent: Dec. 17, 1985

[54] PROCESS FOR TREATING TEXTILE MATERIALS WITH SILICONE-CONTAINING COMPOSITION

[75] Inventors: Malcolm H. Leigh, Congleton, England; Hans Deiner, Neusäss, Fed. Rep. of Germany; George C. Philpott, Wilmslow, England; Ian S. Macklin, High Peak, England; Alan McDonald, Ashton-under-Lyne, England

[73] Assignee: Ciba Geigy Corporation, Ardsley, N.Y.

[21] Appl. No.: 630,468

[22] Filed: Jul. 12, 1984

[30] Foreign Application Priority Data

Jul. 16, 1983 [GB] United Kingdom ..... 8319300

[51] Int. Cl.[4] ..... C08L 83/04; D06M 15/64

[52] U.S. Cl. ..... 8/115.64; 8/495; 8/581; 8/918; 524/860

[58] Field of Search ..... 8/581, 115.64, 495, 8/581

[56] References Cited

U.S. PATENT DOCUMENTS

| | | | |
|---|---|---|---|
| 3,723,481 | 3/1973 | Bobear | 524/439 |
| 3,845,090 | 10/1974 | Nitzsche et al. | 556/446 |
| 4,247,592 | 1/1981 | Kalinowski | 8/581 |
| 4,380,451 | 4/1983 | Steinberger et al. | 8/477 |
| 4,431,472 | 2/1984 | Hohl et al. | 156/307.3 |

FOREIGN PATENT DOCUMENTS 1404356 8/1975 United Kingdom .

*Primary Examiner*—A. Lionel Clingman
*Attorney, Agent, or Firm*—Edward McC. Roberts; Kevin T. Mansfield; Irving M. Fishman

[57] ABSTRACT

A textile material containing cotton and/or synthetic fibres is treated by applying thereto an aqueous emulsion containing an organopolysiloxane elastomer, a hydrophilic organosiloxane-oxyalkylene copolymer and optionally a siloxane curing catalyst, and drying and curing the thus treated material.

19 Claims, No Drawings

PROCESS FOR TREATING TEXTILE MATERIALS WITH SILICONE-CONTAINING COMPOSITION

The present invention relates to a process for treating textile materials such as fabrics composed of synthetic fibres, cotton fibres, or blends thereof with silicone elastomers to impart certain desired properties thereto.

Silicone elastomers have been used to treat wool and other keratinous fibres in order to reduce shrinkage and felting of the fibres during laundering, and to improve the handle and resilient properties of the fibres. In addition silicone elastomers have been used as finishes on cotton and synthetic fibres, although their use has not been fully realised since the oil release and soil redeposition properties are not satisfactory and the moisture absorption is low.

Poor oil release means that fabrics are difficult to wash clean from stains. Poor soil redeposition properties means that if the fabrics are washed together with other dirty fabrics there is a tendency to pick up dirt during the wash. Low moisture absorption makes clothes uncomfortable to wear, particularly in warm or humid conditions. This is particularly the case where the fabrics are worn close to the body as, for instance, shirts and blouses.

Fabrics for use in such situations have normally been finished with other substances such as fluorocarbon finishes. These finishes avoid the disadvantages of silicone elastomers but do not have the same resilient properties.

We have now developed a finish using silicone elastomers which retain the known advantageous properties of silicone elastomers but avoid their disadvantages.

Accordingly the present invention provides a process for treating a textile material containing cotton and/or synthetic fibres which comprises applying to the textile material an aquous emulsion containing (a) an organopolysiloxane elastomer, (b) a crosslinking agent which is an organosiloxane-oxyalkylene copolymer wherein at least one silicon atom of an organosiloxane unit has attached thereto a group having the general formula $$-X(OR)_nO\overset{\overset{Z}{|}}{Si}(R')_a(OR'')_{2-a}, \quad (1)$$

wherein X represents a divalent hydrocarbon group having from 2 to 8 carbon atoms, R represents an alkylene group having from 2 to 4 carbon atoms, n is an integer of at least 2, Z represents an organic group composed of carbon, hydrogen and oxygen and having therein at least one epoxy group, R′ represents a lower alkyl, vinyl or phenyl group, R″ represents an alkyl or an alkoxyalkyl group having less than 7 carbon atoms and 'a' has a value of 0, 1 or 2, the remaining silicon-bonded substituents in the organosiloxane units being selected from hydrogen atoms, monovalent hydrocarbon groups and groups represented by the general formula $$-X(OR)_nOG, \quad (2)$$

wherein X, R and n are as hereinabove defined and G represents a hydrogen atom, a monovalent hydrocarbon group having from 1 to 10 carbon atoms or an acyl group having from 1 to 6 carbon atoms, at least 40 percent of the total substituents bonded to siloxane silicon atoms in the copolymer being methyl, and optionally (c) a siloxane curing catalyst, and drying and curing the thus treated material.

Another object of the present invention is an aqueous emulsion containing the above defined components (a), (b) and optionally (c). In the general formulae (1) and (2), $-(OR)_n-$ represents an oxyalkylene block having at least 2, preferably from 2 to 50, oxyalkylene units OR. The oxyalkylene units are preferably oxyethylene or oxypropylene or combinations of the two, for example $-(OC_2H_4)_6(OC_3H_6)_6-$.

The group X which links the oxyalkylene block to the siloxane silicon atom and may have from 2 to 8 carbons is preferably an alkylene group. In view of the more ready availability of the polyoxyalkylene precursor, X is preferably the propylene group.

The substituents Z is an epoxidised monovalent organic group composed of carbon, hydrogen and oxygen. Examples of such groups include the group

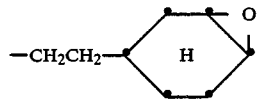

and those represented by the general formula

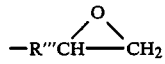

wherein R‴ represents a divalent hydrocarbon group e.g. ethylene, butylene, phenylene, cyclohexylene and

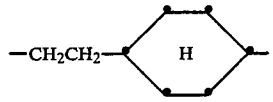

or an ether oxygen-containing group such as $-CH_2CH_2OCH_2CH_2-$ and $-CH_2CH_2OCH(CH_3)CH_2-$. Preferably Z represents the group

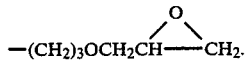

As the R″ groups there may be present any alkyl or alkoxyalkyl group having less than 7 carbon atoms e.g. methyl, ethyl, propyl, methoxyethyl and ethoxyethyl, the preferred copolymers being those wherein R″ represents methyl, ethyl or methoxyethyl. The R′ groups, when present, may be $C_{1-4}$-alkyl, e.g. methyl, ethyl, propyl or butyl; further vinyl or phenyl.

At least one of the above oxyalkylene-containing groups should be present in the copolymer. The number present in any particular case will depend upon such factors as the size of the copolymer molecule desired and the balance sought between the properties bestowed by the siloxane and oxyalkylene portions. The remaining substituents on the siloxane silicon atoms may be selected from hydrogen atoms, monovalent hydrocarbon groups e.g. alkyl having 2 to 12 carbon atoms such as ethyl, propyl, 2,4,4-trimethylpentyl, vinyl, allyl and phenyl and silicon-free oxyalkylene groups of the formula $-X(OR)_nOG$, with the proviso that at least 40 percent of the total siloxane silicon-bonded substituents are methyl groups.

The copolymers may take any of the molecular configurations available to such copolymers provided such configuration is consistent with the presence of terminal silyl groups on the oxyalkylene-containing group. For example they may be of the ABA configuration wherein A represents the group of the formula (1) and B represents a linear siloxane portion, e.g. $-(M_2SiO)_b-$ wherein each M individually represents an organic substituent such as methyl and b is an integer of at least 2.

Alternatively the copolymer may be of the so-called "rake" configuration wherein the oxyalkylene- containing groups are pendant from a siloxane chain as in the compound of the formula

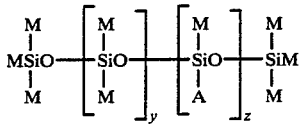

(3)

in which y is zero or an integer, z is an integer and M represents an organic substituent such as methyl.

According to yet another configuration the oxyalkylene-containing groups A may be present both in the pendant positions and attached to the terminal silicon atoms of the siloxane chain. It will thus be apparent that the units comprising the siloxane portion of the copolymer may be selected from monofunctional $M_3SiO_{0.5}$ units, difunctional $M_2SiO$ and trifunctional $MSiO_{1.5}$ units. If desired, small proportions of tetrafunctional $SiO_2$ units may also be present.

The copolymers may be obtained by the reaction of a siloxane-oxyalkylene copolymer wherein the oxyalkylene groups are terminated with COH with a silane $ZR'_aSi(OR'')_{3-a}$ in which Z, R', R'' and 'a' are as hereinbefore defined. Some reaction is believed to occur at normal ambient temperatures. It is preferred, however, to expedite the reaction by the use of higher temperatures, for example, from about 80° to 180° C. If desired the reaction may be carried forward in the presence of a transesterification catalyst, for example zinc tetrafluoroborate, an organic tin compound e.g. stannous octoate or a titanium compound e.g. tetrabutyl titanate. Where subsequent reaction of the copolymer via the epoxy groups is envisaged the preferred catalysts are those which also function to open the epoxy ring e.g. zinc tetrafluoroborate.

The relative molar proportions of the reactants employed may be varied to achieve substantially complete reaction of the available —COH groups, or to induce only partial reaction whereby the resulting copolymer product contains both silylated and non-silylated oxyalkylene groups.

The molecular weight of the copolymers may vary widely and the copolymers may range from mobile liquids to gummy or waxy solids. When a sufficient proportion of oxyethylene units are present the copolymers are water-soluble.

Any organopolysiloxane elastomer which contains groups capable of reacting with reactive groups on the crosslinking agent to form a cured product on the material may be used.

One preferred type are α,ω-polydimethylsiloxane diols having a viscosity at 25° C. of more than $10^2$ $cm^2/sec$ (10,000 cS) and advantageously higher than $10^3$ $cm^2\ sec^{-1}$ (100,000 cS). In these dimethylsiloxanes, the methyl groups can be partially substituted, up to 10 mol %, by phenyl groups, the phenyl groups being incorporated in the molecule in the form of diphenylsiloxy or methylphenylsiloxy groups, or by naphthyl, benzyl, ethylphenyl, ethyl, γ-trifluoropropyl, and -cyanopropyl groups. These silicones all contain those α,ω-hydroxy groups which are required for crosslinking with the crosslinking agent to produce crosslinking under the conditions normally used in the finishing of textiles.

The α,ω-polydimethylsiloxane diols may be transformed into aqueous emulsions by known methods, for instance by the method described in British Patent Specification No. 1404356.

Other preferred elastomers are organopolysiloxanes represented by the general formula $$[R'R_2SiO_{0.5}]_2[R''(CH_3)SiO]_d[R_2SiO]_b\left[(HOOCQ)\overset{R}{\overset{|}{Si}}O\right]_c, \quad (4)$$

wherein Q represents a divalent hydrocarbon group, a divalent group composed of carbon, hydrogen and oxygen, a divalent group composed of carbon, hydrogen and sulphur, or a divalent group composed of carbon, hydrogen, oxygen and sulphur, each R represents a monovalent hydrocarbon group having less than 19 carbon atoms, at least 50 percent of the total R groups being methyl, each R' represents a hydrogen atom, an alkoxy or alkoxyalkoxy group having less than 7 carbon atoms, a monovalent hydrocarbon group having less than 19 carbon atoms, or the group —QCOOH, except that R' may not represent a monovalent hydrocarbon group or the group —QCOOH when d is 0, R'' represent a hydrogen atom or an alkoxy or alkoxyalkoxy group having less than 7 carbon atoms, d is 0 or an integer, b is an integer and c is an integer having a value up to $$\frac{d+b+c+2}{3},$$

at least two of the groups R' and R'' present in the molecule being selected from hydrogen atoms, alkoxy groups having less than 7 carbon atoms and alkoxyalkoxy groups having less than 7 carbon atoms.

In addition to the units specified hereinabove these organosiloxanes may contain small amounts of chain branching units e.g. $RSiO_{1.5}$ and $SiO_2$ units. The organopolysiloxanes are therefore linear or substantially linear polymers which are characterised by the presence of both carboxy-functional groups and silicon-bonded hydrogen atoms, alkoxy groups or alkoxyalkoxy groups. They may vary in molecular size from three up to at least several hundred siloxane units.

In the general formula of the organosiloxanes the divalent group Q that links the carboxyl group to silicon may be for example $-CH_2CH_2-$, $-(CH_2)_3-$, $$-CH_2\overset{CH_3}{\overset{|}{C}}H-,$$

$-CH_2CH(CH_3)CH_2-$, $-CH_2CH_2OCH_2-$ or $-CH_2CH_2SCH_2-$. Preferably Q has from 2 to 8 carbon atoms. At least 50 percent of the total R groups are methyl groups with any remaining R substituents being higher monovalent hydrocarbon groups, for example ethyl, propyl, 2,4,4-trimethylpentyl, vinyl, allyl and phenyl. Examples of R′ and R″ substituents are hydrogen, methoxy, ethoxy, butoxy, methoxyethoxy and ethoxyethoxy. When 'a' is an integer R′ may additionally represent a monovalent hydrocarbon group e.g. a lower alkyl group, a lower alkenyl group or an aryl group such as methyl, ethyl, butyl, vinyl or phenyl or the group —QCOOH. The carboxy groups and the silicon-bonded hydrogen atoms, alkoxy groups and alkoxyalkoxy groups may thus be present on the terminal silicon atoms or pendant in the polymer chain or both.

Thus the elastomer may have the formula $$H(CH_3)_2SiO\,((CH_3)_2SiO)_x\,(CH_3\underset{\underset{\underset{CH_2SCH_2COOH}{|}}{CH_2}}{\overset{|}{SiO}})_y\,Si(CH_3)_2H \qquad (5)$$

wherein x is an integer, preferably from 10 to 200, and y is an integer, preferably from 1 to 50. Specific examples of elastomers of formula (5) are those in which x is 88 and y is 10; x is 120 and y is 30; and the mixture in which x has an average value of 143.5 and y has an average value of 4.5.

The organosiloxanes of formula (4) may be prepared by the equilibration of the corresponding cyclic siloxanes and an appropriate source of end-stopping units e.g. a disiloxane. For example when the R′ substituents are hydrogen atoms and 'a' is zero the organosiloxanes may be prepared by the equilibration of $(R_2SiO)_4$, $$(HOOCQ\overset{\overset{R}{|}}{Si}O)_4$$

and tetramethyldisiloxane. Equilibration procedures are generally known in the silicone art. When R′ represents an alkoxy group the organosiloxanes can be prepared by the reaction of an alkoxy-terminated polyorganosiloxane having pendant silicon-bonded vinyl groups with e.g. mercaptoacetic acid. Such a reaction can be carried out in the presence of a free radical catalyst such as azobisisobutyronitrile. The organosiloxanes may be cross-linked through the silicon-bonded reactive (R′ and R″) groups.

The ratio of elastomer to crosslinking agent used in the present invention may vary over a wide range. The ratio may be from 1:1 to 10:1, preferably 1:1 to 4:1, by weight.

If desired a siloxane curing catalyst may be used to facilitate the cure of the organosiloxanes. A variety of substances are known which will catalyse the curing reaction including the metal organic compounds such as the tin carboxylates e.g. dibutyl tin dilaurate stannous octoate and dibutyl tin dioctoate, acids and bases such as trifluoromethane sulfonic acid.

Other textile auxiliaries, such as means for improving the resistance to creasing, can also be used together with the associated catalysts or plasticisers required. When using crease resisting resins it has been found that when used in conjunction with the treatment of the invention, the quantity of resin needed for a given degree of crease resistance is less than would otherwise be needed. Amounts as low as 50% of those normally needed have been found to be sufficient.

As the system used in the present invention is non-ionic, it is found that optical brightening agents can also be used as they are compatible with the system. It is also possible to use dyestuffs which are commonly used with optical brightening agents to impart a slight bluish or violet tint to the finished material.

The treatment of the invention is preferably carried out by a pad-technique although other methods of application may be used e.g. spraying or kissing. The material is then dried, preferably at elevated temperature of 100° to 120° C. and either allowed to cure at ambient temperature or the material is heated to a temperature of e.g. 140° to 205° C. to accelerate the cure.

Materials treated in accordance with the present invention exhibit superior oil release and soil redeposition properties when compared with material treated with conventional silicone finishes. In addition materials treated in accordance with the invention exhibit much improved water absorbency properties when compared with material treated with conventional silicone finishes which tend to be hydrophobic and do not absorb water.

The resulting handle varies with the elastomer used and ranges from a soft greasy handle when an $\alpha,\omega$-polydimethylsiloxane diol is used to a drier more silk-like handle when an elastomer of general formula (5) is used.

The invention is illustrated with reference to the Examples which follow. In the Examples the following compounds are used:

Elastomer 1 is a silicone emulsion obtained according to Example 1, emulsion B of British patent specification No. 1404356.

Elastomer 2 is an aqueous emulsion of the elastomer as described below.

Elastomer 3 is identical with Elastomer 2 but produced as the 100% fluid. Elastomer 2 is in fact a 25% aqueous emulsion of Elastomer 3.

Crosslinker 1 is an aqueous solution of the compound as described below.

Crosslinker 2 is an aqueous solution of the compound described below.

Crosslinker 3 is an aqueous emulsion of a methyl hydrogen polysiloxane.

Catalyst 1 is dibutyltin dilaurate.

Catalyst 2 is a cationic alkanolamine hydrochloride.

Resin 1 is an N-methylol compound based on cyclic and linear N-methylol compounds.

Resin 2 is a dimethyloldihydroxy-ethyleneurea reactant.

Resin 3 is a precatalysed modified reactant resin.

Surfactant 1 is a non-ionic alkylphenol polyglycol ether.

Surfactant 2 is a preparation of an alkylaryl polyglycol ether sulphate and a polyethylene glycol ether.

Surfactant 3 is a mixed alcohol based wetting agent ($C_3$–$C_8$-alcohols).

Elastomer 2 is prepared as follows:

Octamethylcyclotetrasiloxane (1363 parts), a 90 percent by weight solution in toluene of the cyclic siloxane (942 g) of the formula $$((CH_3)(HOOCCH_2SCH_2CH_2CH_2)\,SiO)_4 \qquad (6)$$

and tetramethyldisiloxane (20.6 g) are heated together to 80° C. under a nitrogen atmosphere. Trifluoromethane sulphonic acid (1.32 g) are then added and the heating continued (80°–91° C.) for four hours. During this period the mixture becomes clear and homogeneous. The catalyst is neutralised and the product cooled and filtered to provide a clear straw-coloured liquid.

Crosslinker 1 is prepared as follows:

To a 20 liter split-necked flask equipped with a stirrer, condenser and thermometer are charged 12,500 g of a siloxane-oxyalkylene copolymer of the formula $$(HO(CH_2CH_2O)_{12}(CH_2)_3Si(CH_3)_2O_{0.5})_2(Si(CH_3)_2O)_{14} \quad (7)$$

average composition.

The flask is heated to 90° C. and a 40% by weight aqueous solution (26 ml) of zinc tetrafluoroborate added and dissolved with stirring. This is followed by the addition over 25 minutes of the silane of the formula

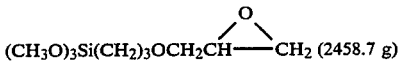

(8)

the reaction mixture then being maintained at 90° C. for a further 2 hours. On cooling there is obtained 14,870 parts of a clear, amber, water-soluble liquid.

Crosslinker 2 is prepared as follows:

Employing the procedure set out for crosslinker 1, a siloxane-oxyalkylene copolymer (240 g) of the formula

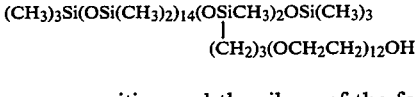

(9)

average composition and the silane of the formula

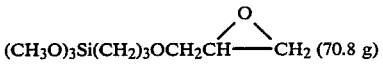

(10)

are reacted at 90°–100° C. in the presence of a 40% by weight aqueous solution (3 ml) of zinc tetrafluoroborate. The reaction product (304 g) is clear, amber water-soluble liquid.

EXAMPLE 1

Samples of knitted polyester/nylon fabric were treated with the following recipes, in g/liter of bath:

TABLE 1

| Recipe No. | 1 | 2 | 3 | 4 | 5 |
|---|---|---|---|---|---|
| Elastomer 1 | 30 | 30 | 30 | 30 | 30 |
| Crosslinker 3 | 6 | — | — | — | — |
| Catalyst 1 | 2 | — | — | — | — |
| Crosslinker 1 | — | 10 | 10 | 5 | 5 |
| Catalyst 2 | — | — | 1 | — | 1 |

using a pad/dry application method, i.e. pad at 66% pick-up dried at 120° C. for 1 minute. The resulting fabrics were allowed to cure for a period of 3 days at room temperature.

On testing the fabrics for resistance to soil redeposition and oil release it was found that all the recipes incorporating the hydrophilic Crosslinker 1 exhibited superior oil release and soil redeposition properties than did that incorporating the conventional Crosslinker 3/Catalyst 1 products. Furthermore the addition of Catalyst 2 to the system improved both oil release and resistance to soil properties irrespective of the elastomer:hydrophilic crosslinker ratio.

In addition the fabrics treated with the recipes incorporating the hydrophilic Crosslinker 1 exhibited much improved water absorbency properties than did that treated with a conventional elastomer system i.e., Recipe No. 1, which has no water absorbence.

EXAMPLE 2

100% knitted cotton single jersey fabric which had been previously dyed to a royal blue shade was treated with the following recipes, in g/liter of bath:

TABLE 2

| Recipe No. | 1 | 2 |
|---|---|---|
| Resin 1 | 65 | 65 |
| Elastomer 1 | 30 | 30 |
| Crosslinker 3 | — | 10 |
| Crosslinker 1 | 10 | — |
| Catalyst 2 | 2 | 2 |
| Magnesium Chloride | 6.5 | 6.5 |
| Ammonium Chloride | 0.65 | 0.65 |
| Surfactant 1 | 2.0 | 2.0 |
| Acetic Acid (80%) | 1.0 | 1.0 |

The fabric was dried and cured at 165° C., and the resulting fabrics examined for oil release, resistance to soil redeposition, and stretch recovery properties.

It was found that the fabric treated with recipe 1 incorporating Crosslinker 1 exhibited improved oil release and resistance to soil properties when compared with that incorporating conventional Crosslinker 3. The water absorbence property of the fabric treated with Recipe No. 1 was much better than that of the fabric treated with Recipe No. 2. The stretch recovery properties of the fabric treated with Recipe No. 1 were not significantly affected when compared with that treated with the conventional Recipe No. 2.

EXAMPLE 3

1000 meters of woven 67/33 polyester/cotton workwear fabric were treated in bulk with the following recipe where the ratio of elastomer to crosslinker is 1:1:

50 g/l Resin 2
10 g/l Magnesium Chloride (50% Solution)
1 g/l Surfactant 1
15 g/l Elastomer 1
15 g/l Crosslinker 1
1.5 ml/l Acetic Acid (80%)

using a pad/flash cure technique, i.e. pad at 50% pick-up cure at 190°–205° C.

The resulting fabric exhibited excellent oil release, water absorbence and resistance to soil redeposition.

EXAMPLE 4

A further 2×1000 meters of woven 67/33 polyester cotton workwear fabric was processed using the same essential recipe as that quoted in Example 3, the ratio of elastomer:crosslinker being reduced from 1:1 to 3:2 approximately i.e., 15 g/l Elastomer 1 plus 9 g/l Crosslinker 1.

The resulting fabric exhibited the same excellent oil release, water absorbence and resistance to soil redeposition properties as that obtained in Example 3.

EXAMPLE 5

Swatches of woven 50/50 polyester/cotton sheeting fabric were treated in the laboratory with the following recipes in g/liter of bath:

TABLE 3

| Recipe No. | 1 | 2 |
|---|---|---|
| Resin 2 | 25 | 25 |
| Magnesium Chloride | 10 | 10 |
| Elastomer 1 | 25 | 15 |
| Crosslinker 3 | 5 | — |
| Catalyst 1 | 2 | — |
| Crosslinker 1 | — | 15 |
| Acetic Acid (80%) | 1 | — |

under the following conditions: pad at 67% pick-up, dry for 1 minute at 120° C. and cure for 30 seconds at 180° C.

When tested for oil release and resistance to soil redeposition, the fabric treated with Recipe No. 2 exhibited significantly improved oil release and soil redeposition properties to that finished with the conventional Recipe No. 1.

In addition the fabric treated with Recipe No. 2 incorporating gave a noticeably softer handle and much improved water absorbency properties to that finished with the Recipe No. 1.

EXAMPLE 6

Swatches of woven 50/50 polyester/cotton sheeting fabric were treated in the laboratory with the following recipes, in g/liter of bath:

TABLE 4

| Recipe No. | 1 | 2 |
|---|---|---|
| Resin 2 | 25 | 25 |
| Magnesium Chloride | 10 | 10 |
| Elastomer 1 | 25 | 15 |
| Crosslinker 3 | 5 | — |
| Catalyst 1 | 2 | — |
| Crosslinker 2 | — | 15 |
| Acetic Acid (80%) | 1 | 1 |

under the following conditions: pad at 67% pick-up, dry for 1 minute at 120° C. and cure for 30 seconds at 180° C.

When tested for oil release and resistance to soil redeposition the fabric treated with Recipe No. 2 exhibited significantly improved oil release and soil redeposition properties to that finished with the conventional Recipe No. 1.

In addition the fabric treated with Recipe No. 2 exhibited much improved water absorbency properties than did that treated with the conventional Recipe No. 1.

EXAMPLE 7

Swatches of woven 67/33 polyester/cotton workwear fabric were treated in the laboratory with the same recipes as those detailed in Example 5.

When tested for oil release, soil redeposition and water absorbency properties the same effects were obtained as those previously obtained on 50/50 polyester/cotton sheeting and also described in Example 5.

EXAMPLE 8

Swatches of woven 67/33 polyester/cotton workwear fabric were treated in the laboratory with the same recipes as those detailed in Example 6.

When tested for oil release, soil redeposition and water absorbency properties the same effects were obtained as those previously obtained on 50/50 polyester/cotton sheeting fabric and also described in Example 6.

EXAMPLE 9

Swatches of woven 50/50 polyester/cotton sheeting fabric were treated in the laboratory with the following recipes in g/liter of bath:

TABLE 5

| Recipe No. | 1 | 2 | 3 |
|---|---|---|---|
| Resin 2 | 25 | 25 | 25 |
| Magnesium Chloride | 10 | 10 | 10 |
| Elastomer 2 | 15 | 15 | 25 |
| Crosslinker 1 | 15 | — | — |
| Crosslinker 2 | — | 15 | — |
| Crosslinker 3 | — | — | 5 |
| Catalyst 1 | — | — | 1 |
| Acetic Acid (80%) | 1 | 1 | 1 |

under the following conditions: pad at 66% pick-up, dry for 1 minute at 120° C. and cure for 30 seconds at 180° C.

The fabrics treated with Recipes No. 1 and 2 exhibited better oil release and resistance to soil redeposition properties than that treated with Recipe No. 3 and, in addition, exhibited much improved water absorbency properties.

Furthermore, Recipes No. 1 and 2 imparted a noticeably softer handle to the fabric than was obtained using Recipe No. 3 with the conventional crosslinker and catalyst.

EXAMPLE 10

Three qualities of 100% knitted polyester fabric sold under the Trade Names Ultressa®, Suraweave® and Gabadream® were treated with the following recipe:

1.5% Elastomer 1
0.5% Crosslinker 1
0.05% Catalyst 2

(where % figures represent % 'of weight of fibre' product add on) by padding at a liquor retention of 82% followed by drying at 170° C. for 1 minute.

When tested for oil release and resistance to soil redeposition properties all three qualities of fabric exhibited very good results.

In addition this finish imparted a noticeably softer handle to all three fabrics as well as improving the stretch recovery and water absorbency properties of all fabrics.

EXAMPLE 11

300 meters of woven 50/50 polyester/cotton sheeting fabric were processed in bulk using the following recipe where the ratio of elastomer:crosslinker was 4:1:

40 g/l Resin 2
35 g/l Magnesium Chloride (30% solution)
3 g/l Surfactant 2
10 g/l Elastomer 1
2.5 g/l Crosslinker 1
1 g/l Formic Acid (conc)

under the following conditions: pad at 49% Pick-up, dry over cans at 130° C. and cure for 30 seconds at 190° C.

The finished fabric exhibited good oil release, resistance to soil redeposition and water absorbency properties.

EXAMPLE 12

A further 1700 meters of woven 50/50 polyester/cotton sheeting fabric (the same fabric as described in Example 11) were processed in bulk using the following recipe, where the elastomer:crosslinker ratio was adjusted to give a 1:1 ratio:

40 g/l Resin 2
35 g/l Magnesium Chloride (30% solution)
3 g/l Surfactant 2
15 g/l Elastomer 1
15 g/l Crosslinker 1
1 g/l Formic Acid (conc)

under the following conditions: pad at 49% pick-up, dry over cans at 130° C. and cure for 30 seconds at 190° C.

The finished fabric exhibited the same oil release, resistance to soil redeposition and fabric absorbency properties as those obtained in Example 11.

EXAMPLE 13

500 meters of woven 67/33 polyester/viscose dress fabric were processed in bulk using the following recipe where the ratio of elastomer:crosslinker was 4:1:

150 g/l Resin 3
24 g/l Elastomer 1
6 g/l Crosslinker 2
2 g/l Surfactant 3 under the following conditions: pad at 60% pick-up and dry/cure-flash cure for 45 seconds at 185° C.

The finished fabric exhibited good water absorbency properties linked with good easy care and soft handling characteristics.

EXAMPLE 14

5000 meters of woven 50/50 polyester/cotton sheeting fabric were processed in bulk using the following recipe where the elastomer/crosslinker ratio was 5:3:

75 g/l Resin 2
25 g/l Magnesium Chloride (50% solution)
25 g/l Elastomer 1
15 g/l Crosslinker 2
0.5 ml/l Acetic Acid (80%)

under the following conditions: pad at 65% pick-up, dried on cans to 15–20% moisture content at 110° C. and stenter cured at 185° C. for 25–30 seconds.

The finished fabric exhibited good oil release, resistance to soil redeposition and produced a handle finish that was more attractive than the standard finish in use.

EXAMPLE 15

10,000 meters of woven 100% cotton dresswear fabric were processed in bulk using the following recipe where the elastomer:crosslinker ratio was 6:1:

100 g/l Resin 2
17 g/l Magnesium Chloride
24 g/l Elastomer 1
4 g/l Crosslinker 2
2 g/l Surfactant 1 under the following conditions: pad at 50–55% pick-up, dry for 1 minute at 150° C. and cure for 4 minutes at 150° C.

The resultant fabric had a pleasant smooth handle with good stain release properties.

EXAMPLE 16

2 meter lengths of a variety of polyester/viscose dresswear fabrics were treated under bulk processing conditions with Elastomer 3 which had been previously converted into the sodium salt (cf. below).

To produce the sodium salt, 1 part Elastomer 3 was mixed with 2 parts water. Sodium hydroxide (in pellet form) was added until a clear solution with a pH value of 8 was obtained. The resulting clear solution was further diluted with water to produce a 10% solution of Elastomer 3 sodium salt.

TABLE 6

| Recipe No. | 1 | 2 |
|---|---|---|
| Elastomer 3 (Na Salt) | 10 | 20 |
| Crosslinker 3 | 8 | 16 |
| Catalyst 2 | 4 | 8 |

under the following conditions: pad at 65% pick-up and dry/cure at 90 seconds at 150° C.

The finished fabrics possessed a smooth springy handle with good stain release and low soil redeposition.

We claim:

1. A process for treating a textile material containing cotton or synthetic fibers which comprises applying to the textile material an aqueous emulsion containing (a) an organopolysiloxane elastomer, (b) a crosslinking agent which is an organosiloxane-oxyalkylene copolymer wherein at least one silicon atom of an organosiloxane unit has attached thereto an oxyalkylene-containing group A having the formula $$-X(OR)_nO\overset{\overset{Z}{|}}{Si}(R')_a(OR'')_{2-a},$$

wherein X represents a divalent hydrocarbon group having from 2 to 8 carbon atoms, R represents an alkylene group having from 2 to 4 carbon atoms, n is an integer of at least 2, Z represents an organic group composed of carbon, hydrogen and oxygen and having therein at least one epoxy group, R′ represents a lower alkyl, vinyl or phenyl group, R″ represents an alkyl or an alkoxyalkyl group having less than 7 carbon atoms and a has a value of 0, 1 or 2, the remaining silicon-bonded substituents in the organosiloxane units being selected from hydrogen atoms, monovalent hydrocarbon groups and groups represented by the general formula $$-X(OR)_nOG,$$

wherein X, R and n are as hereinabove defined and G represents a hydrogen atom, a monovalent hydrocarbon group having from 1 to 10 carbon atoms or an acyl group having from 1 to 6 carbon atoms, at least 40 percent of the total substituents bonded to siloxane silicon atoms in the copolymer being methyl, and optionally (c) a siloxane curing catalyst, and drying and curing the thus treated material.

2. A process according to claim 1, wherein R represents an ethylene or propylene radical and n is from 2 to 50.

3. A process according to claim 1, wherein X is alkylene having from 2 to 8 carbon atoms.

4. A process according to claim 1 wherein the copolymer is of the ABA configuration where B represents a linear siloxane radical.

5. A process according to claim 4, wherein B is a radical of the formula $-(M_2SiO)_b-$, where M is methyl and b is an integer of at least 2.

6. A process according to claim 1 in which the copolymer is of the so-called "rake" configuration wherein the oxyalkylene-containing groups A are pendant from a siloxane chain.

7. A process according to claim 1, wherein the elastomer is an $\alpha,\omega$-polydimethyl-siloxane diol having a viscosity at 25° C. of more than $10^2$ $cm^2/sec$.

8. A process according to claim 7 wherein the elastomer has a viscosity at 25° C. of more than $10^3$ $cm^2/sec$.

9. A process according to claim 1 wherein the elastomer is an organopolysiloxane of the formula $$[R'R_2SiO_{0.5}]_2[R''(CH_3)SiO]_d[R_2SiO]_b\left[(HOOCQ)\overset{R}{\overset{|}{Si}}O\right]_c,$$

wherein Q represents a divalent hydrocarbon group, a divalent group composed of carbon, hydrogen and oxygen, a divalent group composed of carbon, hydrogen and sulphur, or a divalent group composed of carbon, hydrogen, oxygen and sulphur, each R represents a monovalent hydrocarbon group having less than 19 carbon atoms, at least 50 percent of the total R groups being methyl, each R' represents a hydrogen atom, an alkoxy or alkoxyalkoxy group having less than 7 carbon atoms, a monovalent hydrocarbon group having less than 19 carbon atoms or the group —QCOOH, except that R' may not represent a monovalent hydrocarbon group or the group —QCOOH when d is 0, R'' represents a hydrogen atom or an alkoxy or alkoxyalkoxy group having less than 7 carbon atoms, d is 0 or an integer, b is an integer and c is an integer having a value up to $$\frac{d+b+c+2}{3}$$

at least two of the groups R' and R'' present in the molecule being selected from hydrogen atoms, alkoxy groups having less than 7 carbon atoms and alkoxyalkoxy groups having less than 7 carbon atoms.

10. A process according to claim 9, wherein Q is a group of the formula $—CH_2CH_2—$, $—(CH_2)_3—$, $$—CH_2—\overset{CH_3}{\overset{|}{CH}}—,$$

$—CH_2CH(CH_3)CH_2—$, $—CH_2CH_2OCH_2—$ or $—CH_2CH_2SCH_2—$.

11. A process according to claim 9 wherein the elastomer has the formula $$H(CH_3)_2SiO(CH_3SiO)_x(CH_3\overset{\overset{CH_2}{|}}{\underset{\underset{CH_2—SCH_2COOH}{|}}{Si}}O)_ySi(CH_3)_2H$$

in which x is an integer and y is an integer.

12. A process according to claim 11 wherein the elastomer is selected from compounds of formula according to claim 11 in which (a) x is 88 and y is 10, (b) x is 120 and y is 30 and (c) the mixture in which x has as average value of 143.5 and y has an average value of 4.5.

13. A process according to claim 1, wherein the ratio of elastomer to crosslinking agent is from 1:1 to 10:1 by weight.

14. A process according to claim 13, wherein the ratio of elastomer to crosslinking agent is from 1:1 to 4:1 by weight.

15. A process according to claim 1, wherein the siloxane curing catalyst is a tin carboxylate, an acid or a base.

16. A process according to claim 1, wherein the textile material is simultaneously treated with a crease resisting resin, an optical brightening agent or a dyestuff.

17. A process according to claim 1, which is carried out by a pad-technique.

18. A process according to claim 1, wherein the treated material is dried and cured at elevated temperature.

19. An aqueous emulsion containing an organopolysiloxane elastomer, a crosslinking agent and optionally a siloxane curing catalyst according to claim 1.

* * * * *